United States Patent [19]

Baumann et al.

[11] 4,165,168

[45] Aug. 21, 1979

[54] ELECTROPHOTOGRAPHIC DOCUMENT COPIER MACHINE WITH MODULAR PAPER PATH ASSEMBLY

[75] Inventors: Gerald W. Baumann; Robert L. Burdick, both of Boulder, Colo.; Willie Goff, Jr., Austin, Tex.; Edwin L. Libby, Longmont, Colo.

[73] Assignee: International Business Machines Corporation, Armonk, N.Y.

[21] Appl. No.: 864,058

[22] Filed: Dec. 23, 1977

[51] Int. Cl.[2] ..... G03G 15/00

[52] U.S. Cl. ..... 355/3 R

[58] Field of Search ..... 355/3 R, 8, 11, 14, 355/3 DR, 133

[56] References Cited

U.S. PATENT DOCUMENTS

| | | | |
|---|---|---|---|
| 3,322,098 | 5/1967 | Pegram | 355/10 X |
| 3,512,885 | 5/1970 | Osborne et al. | 355/14 |
| 4,030,823 | 3/1975 | Brugger et al. | 355/8 |

*Primary Examiner*—R. L. Moses

*Attorney, Agent, or Firm*—Charles E. Rohrer

[57] ABSTRACT

An electrophotographic machine of the transfer type wherein a modular construction is provided including a main slide-out drawer upon which the entire paper path is mounted as well as the transfer corona. Included in the main drawer are the paper supply bins, paper feeding mechanisms, transport guides and conveyors, the transfer corona, detach means, and the fuser. The paper supply bins are mounted in individual mini-drawers separate from but located within the main drawer.

2 Claims, 4 Drawing Figures

ELECTROPHOTOGRAPHIC DOCUMENT COPIER MACHINE WITH MODULAR PAPER PATH ASSEMBLY

This invention relates to an electrophotographic document copier machine and more particularly to the provision of the entire paper path in a modular assembly located in a drawer of the machine.

BACKGROUND OF THE INVENTION

In document copier machines employing the use of pre-cut sheets of copy paper it is a foregone conclusion that there will be some paper feed failures. It is a virtual impossibility to design and build a paper path with the many functions that are performed on the paper path of a document copier machine that will feed paper with 100% reliability, particularly in view of the fact that numerous types and qualitites of paper exist. It is an advantage of the invention described herein that paper jams can be removed in a much easier manner by the casual operator than heretofore possible. This will provide for minimum interruption of the job and can avoid service repair calls, the resulting downtime and cost.

Unfortunately, machines of the prior art, once jammed, require the operator or the serviceman to reach into the mechanisms of the machine in order to remove the jammed sheet. This is true even where the jammed sheet is near the document copier fuser, which can be quite hot, with the consequent danger of being burned. Therefore, another advantage of this invention is to allow for easy paper jam removal by providing access to the entire paper path and providing such access without the need for reaching into the machine itself.

When a machine is in need of repair, significant cost savings are realized when those repairs can be performed quickly. It is an advantage of this invention that the machine is configured in such a way that repairs required to the mechanisms in the paper path are more easily accomplished because those mechanisms are more easily reached.

Assembly costs of copier machines are relatively high due to the complexity of the mechanisms involved. Consequently, it is desirable to provide a modular construction whereby significant portions of the machine can be constructed independently of other portions. It is a further advantage of this invention in that it provides a modular paper path whereby all parts of the path and its capability for assembly are separate from the remainder of the machine.

In summary, this invention provides easy paper jam clearance, improved serviceability, lower assembly costs and improved safety for the casual operator.

SUMMARY OF THE INVENTION

This invention is the provision of the entire paper path of a document copier machine in a slide-out drawer, together with the transfer corona, such that when the drawer is pulled out to the front of the machine the paper supply bins, the paper feed mechanisms, the transport guides and conveyors, the transfer corona, the detach means, the fuser device and the exit transport are all contained in the drawer. The drawer pulls out far enough to provide complete access to these elements. Additionally, the paper supply bins are individually mounted in mini-drawers separate from but located within the main drawer.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
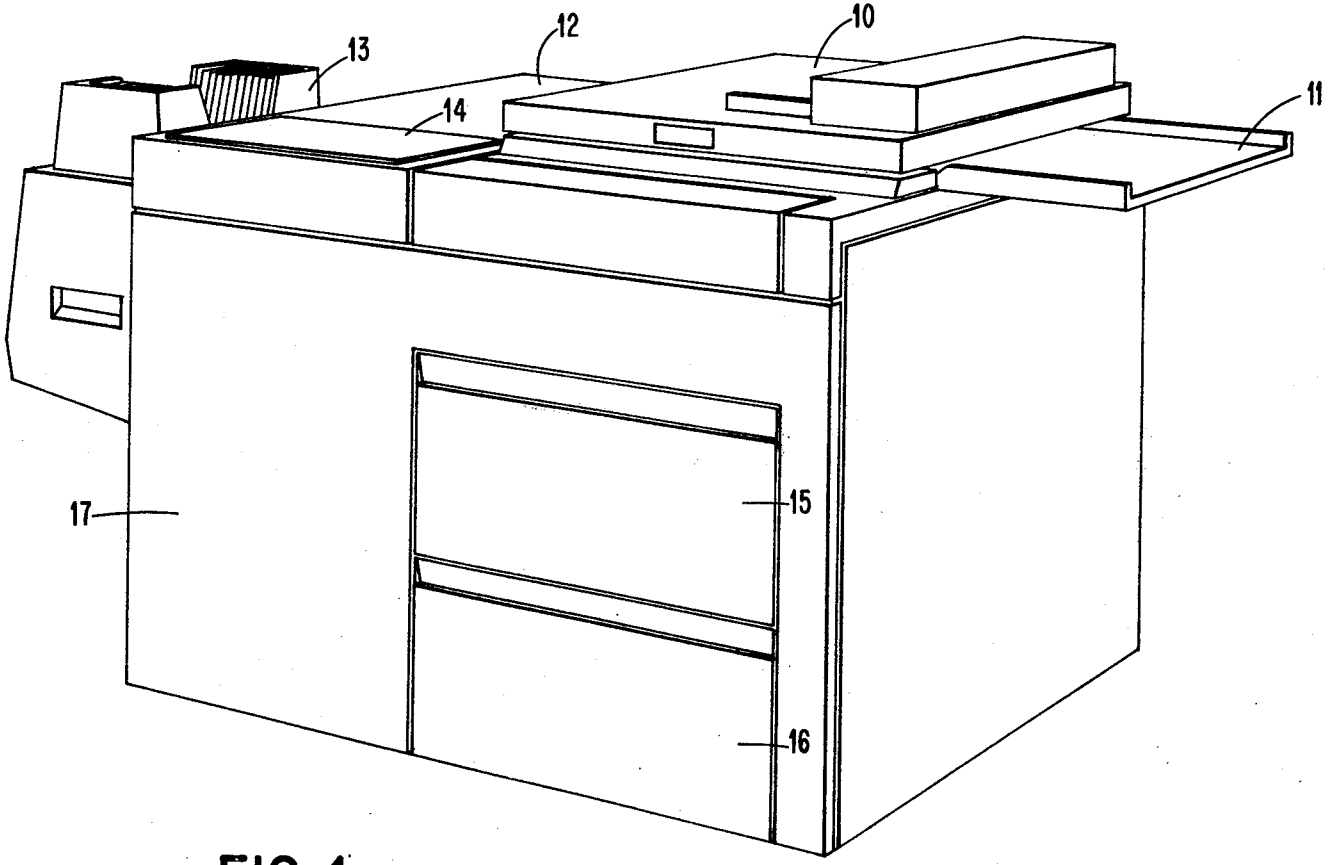
FIG. 1 shows the exterior of a typical electrophotographic copier machine embodying the instant invention.
Figure 2:
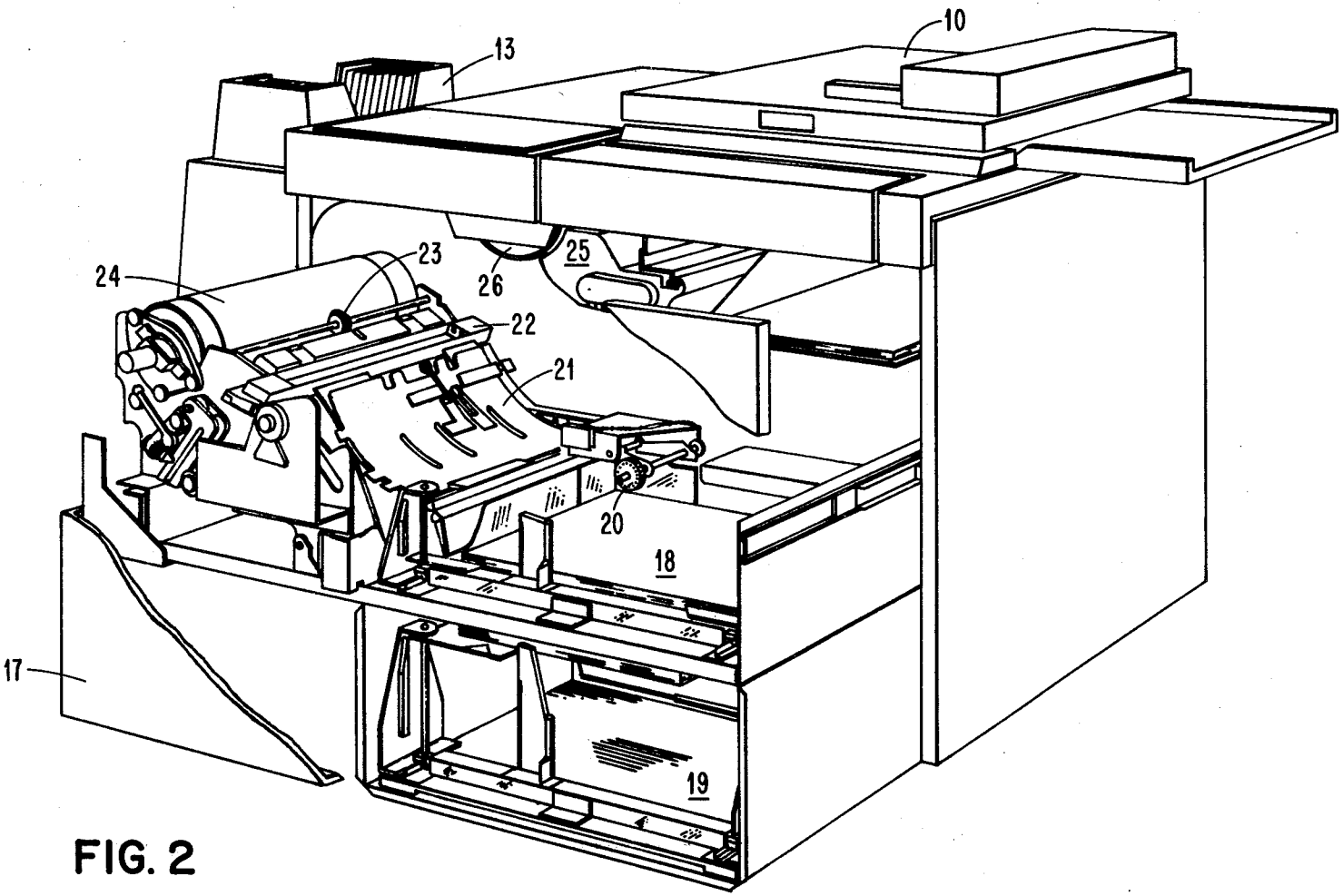
FIG. 2 shows the same machine as FIG. 1, but with the interior of the machine residing in an open drawer.

FIGS. 1 and 2 show the machine including the instant invention with the drawer containing the paper path closed (FIG. 1) and the machine with the drawer containing the paper path open (FIG. 2).

FIG. 1 shows the document copier machine with an automatic document feed mechanism shown at 10 and a semi-automatic feed tray 11 for feeding original documents in serial fashion to a document glass. After being copied, the original documents are exited onto an exit tray 12 while the copies are produced in a collator 13. The control panel for operating the machine is shown at 14. A mini-drawer for loading paper into an upper paper bin is shown at 15 and a similar mini-drawer for loading paper into a lower paper bin is shown at 16. Either drawer 15 or drawer 16 may be opened in order to replenish the copy paper supply once it has been exhausted or to place a different type of paper into the paper bin.

The entire front of the machine is a main drawer 17 which can be opened to expose the entire paper path as shown in FIG. 2.

FIG. 2 shows the main drawer 17 in open position, exposing the upper paper bin 18 and the lower paper bin 19 as well as the entire paper path into which paper from one of these two bins is fed. For example, a paper feed mechanism 20 is shown for the upper paper bin. A similar mechanism is located in the lower paper bin but is not visible in FIG. 2. Paper sheets are fed from one or the other of the two paper bins singly between paper transport guides 21 to a transfer station located just above transfer corona 22. From there the paper is fed under guide means 23 into the nip of the fuser rolls. Only fuser roll 24 is visible in FIG. 2. As the paper exits from the nip of the fuser rolls it passes through an exit transport, hidden from view, into the collator 13. All mechanisms in the paper path from the paper bin 18 through the exit transport just prior to entry into the collator 13 are located in the main drawer shown in the open position in FIG. 2.

Mechanisms not in the main drawer 17 include the developer 25 and the electrophotographic drum 26. Additionally, optical components, not visible in FIG. 2, are located under the automatic document feed mechanism 10 and not in the slide-out drawer 17. A main motor is located to the rear of the machine not in drawer 17.

Figure 3:
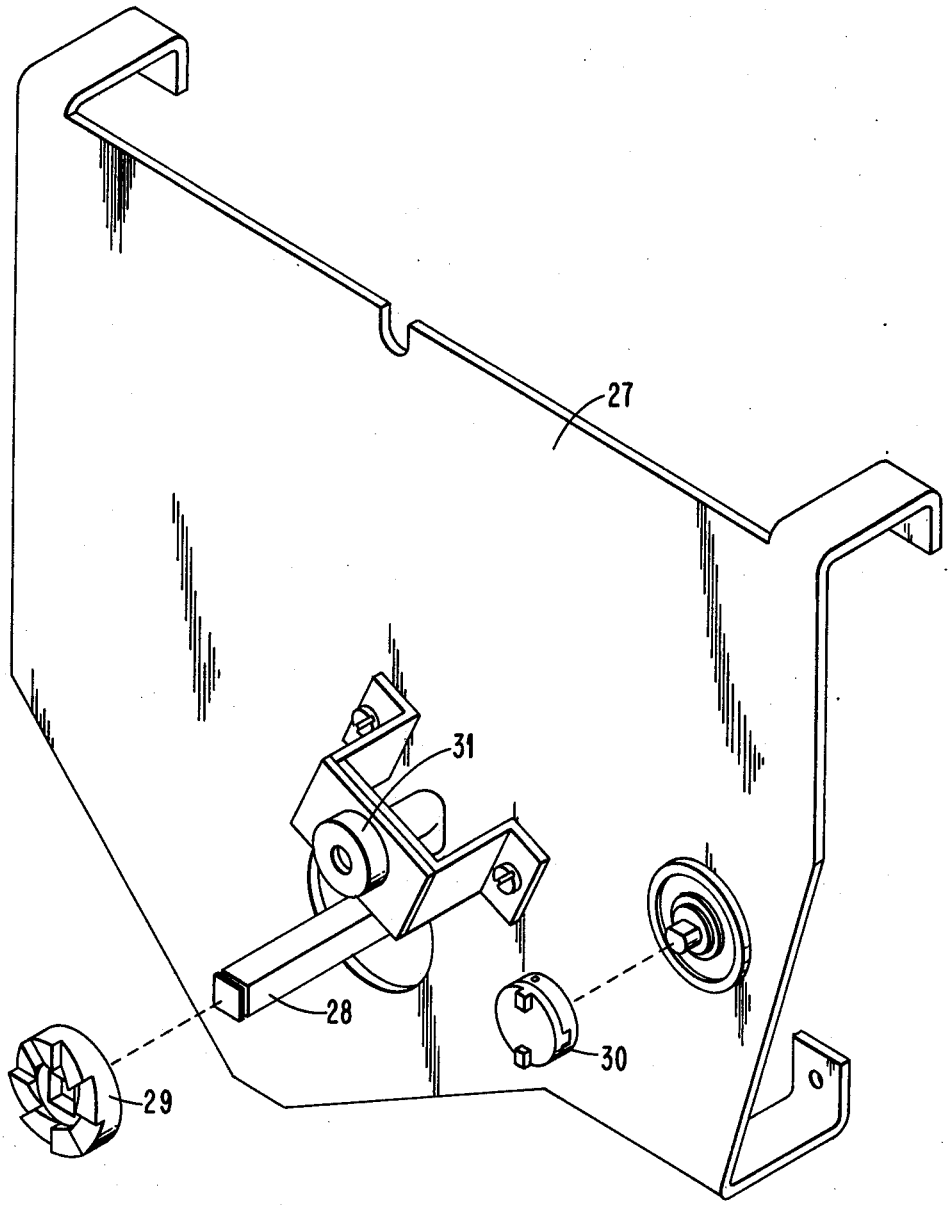
FIG. 3 shows power take-off means.

Means for driving the fuser and other mechanically moving portions of the paper path is provided to the drawer 17 through a power takeoff coupling shown in FIG. 3. The stationary frame bulkhead is shown at 27 with a rotating shaft 28 which is driven from the main machine motor. A coupling 29 is provided to engage with a similar coupling mounted in the main drawer. Alternatively, a separate motor could be mounted in the main drawer to drive the mechanisms therein, and appropriate timing circuits provided to match drawer operation with those outside the drawer.

In order to drive developer 25 another coupling 30 is shown in FIG. 2 which mates with a similar coupling on the developer. The developer is not located in the movable drawer 17, but is mounted on rails for easy slide-out removal.

Figure 4:
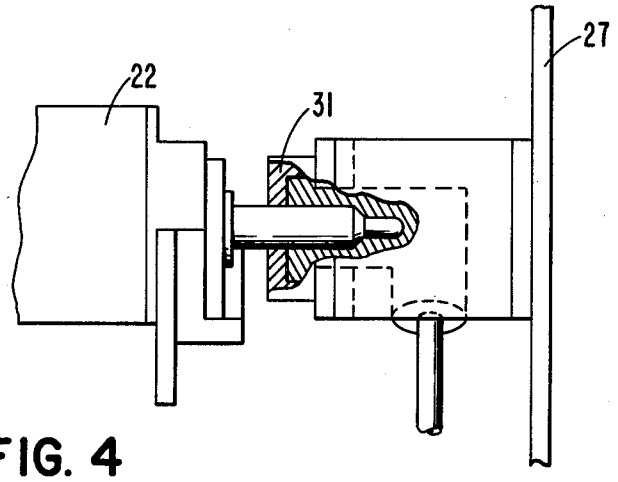
FIG. 4 shows the electrical connector to the transfer corona.

In order to provide power to the transfer corona 22 an electrical connector is shown mounted on the frame bulkhead 27 in FIG. 3. The connector is shown in detail in FIG. 4. All other electrical components in the main drawer 17, such as the motors used to lift the bins 18 and 19 to the paper feed mechanism 20, and all other needed control signals are supplied through cables such as that shown in IBM TECHNICAL DISCLOSURE BULLETIN Vol. 19, No. 9, February 1977, p. 3288.

PRIOR ART

The prior art does not disclose a construction of the type described herein. Throughout the long history of xerographic machines, drawers have been little used except for holding copy paper. This is probably a result of the mechanical complexity of the mechanisms used in copier machine paper paths, and to machine design which intertwined the paper path irretrievably amongst other machine components. The inventors herein have invented a machine design in which an extremely short and simple, relatively straight-line paper path has become an actuality with the resultant capability of mounting the paper path and its mechanisms in a slide-out drawer. Thus, for the first time, the significant advantages mentioned above under the Background of the Invention have been realized.

As stated above, copy paper bins have been placed in drawers in xerographic machines. In the much simpler machines in which photoreceptive copy paper is used, U.S. Pat. Nos. 3,779,638 and 3,976,371 show units which open up or have portions of the unit in a drawer. U.S. Pat. No. 4,017,169 relates to a xerographic machine and shows a small portion of the paper path around a transfer station in a retractable housing while U.S. Pat. No. 4,030,823 shows an arrangement where the entire innards of the machine are movable out of the machine exterior cabinet although the innards themselves do not open up. U.S. Pat. No. 3,985,436 shows a unit in which a portion of the machine is removable for efficient maintenance. These patents demonstrate the attention which is being given to ease of jam clearance or ease of serviceability, and demonstrate, by comparison, the significant advantages achieved by the invention herein.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. In an electrophotographic machine of the transfer type including a photoconductor material upon which images of documents to be copied are reproduced, a modular construction wherein a slide-out main drawer is provided upon which is mounted the copy paper path mechanisms, said main drawer including:

at least one copy paper storage bin for holding a supply of copy paper;

copy paper feed means for moving said paper out of said bins;

transport means for receiving said paper from said feed means and moving said copy paper to a transfer station whereat said paper receives the image on said photoconductor;

a transfer corona;

fuser means for impressing said image on said copy paper, and wherein said storage bin is mounted in a mini-drawer separate from but within said main drawer whereby said storage bin is made accessible without opening said main drawer.

2. The machine of claim 1 wherein said main drawer includes detach means to remove said paper from said photoconductor.

* * * * *